US005748163A

United States Patent [19]

Han

[11] Patent Number: 5,748,163

[45] Date of Patent: May 5, 1998

[54] DITHERING PROCESS FOR PRODUCING SHADED IMAGES ON DISPLAY SCREENS

[75] Inventor: Robin S. Han, Saratoga, Calif.

[73] Assignee: Cirrus Logic, Inc., Fremont, Calif.

[21] Appl. No.: 61,804

[22] Filed: May 17, 1993

Related U.S. Application Data

[63] Continuation-in-part of Ser. No. 813,036, Dec. 24, 1991, abandoned.

[51] Int. Cl.[6] ..... G09G 3/36

[52] U.S. Cl. ..... 345/88; 345/89; 345/148; 345/149

[58] Field of Search ..... 358/455, 429; 382/54, 169; 345/89, 88, 113, 136, 139, 147, 148, 149, 150, 152, 153

[56] References Cited

U.S. PATENT DOCUMENTS

| | | | |
|---|---|---|---|
| 3,716,658 | 2/1973 | Rackman | 178/7.3 D |
| 3,735,182 | 5/1973 | Dalton . | |
| 3,937,878 | 2/1976 | Judice . | |
| 4,100,579 | 7/1978 | Ernstoff . | |
| 4,385,293 | 5/1983 | Wisnieff . | |
| 4,390,874 | 6/1983 | Woodside et al. | 340/812 |
| 4,427,978 | 1/1984 | Williams . | |
| 4,427,979 | 1/1984 | Clerc . | |

(List continued on next page.)

FOREIGN PATENT DOCUMENTS

| | | | |
|---|---|---|---|
| 0 193 728 A2 | 1/1986 | European Pat. Off. | G09G 3/20 |
| 0 271 960 | 12/1986 | European Pat. Off. . | |
| 0 364 307 | 4/1990 | European Pat. Off. . | |
| 0 387 033 | 9/1990 | European Pat. Off. | 345/149 |
| 3906924 A1 | 3/1989 | Germany | G09G 3/20 |
| 58-220182 | 11/1983 | Japan . | |
| 58-220181 | 12/1983 | Japan . | |
| 58-220183 | 12/1983 | Japan . | |
| 2 204 174 | 11/1988 | United Kingdom . | |
| WO90/12388 | 10/1990 | WIPO . | |

OTHER PUBLICATIONS

"New Technologies Sharpen Laptop Displays," International Electronic Design, Feb. 1989, pp. 45–48.

p. 38, Technical Manual, SED 1341 $F_{OE}$, 1988, SMOS Systems, Inc.

S–MOS Systems, Inc. sales brochure for "Dragon Graphic Chip Sets" (Preliminary), undated.

Maltese, Paolo et al., "Addressing Cycles for Fast Settling Grey Shades in Ferroelectric Liquid Crystal Matrices", Ferroelectrics, 1988, vol. 85, pp. 265–274.

Witten, Ian H. et al., "Using Peano Curves for Bilevel Display of Continuous–Tone Images", IEEE Computer Graphics and applications, vol. 2, No. 3, May 1982, pp. 47–51.

*Primary Examiner*—Steven Saras

*Attorney, Agent, or Firm*—Limbach & Limbach; William Alford; Steven A. Shaw

[57] ABSTRACT

Shaded or color images are simulated using frame modulation techniques on flat panel displays having an array of binary display elements, i.e., display elements that have only two display states, an ON state and an OFF state. The timing of ON/OFF and OFF/ON state transitions of picture elements within predetermined neighborhoods through the array of display elements is coordinated such that the state transitions occur substantially uniformly in space and time during a multi-frame display sequence. Using a multi-frame sequence 16 frames in duration, 16 shades of gray may be realized on a monochrome display. The number of shades may be increased to 64 using dynamic dithering. Dithering is applied by causing the multi-frame sequence to be 64 frames in duration and dividing the multi-frame sequence into four sub-sequences each 16 frames in duration with the duty cycle of each display element during each of the four 16-frame sub-sequences being allowed to assume one of two adjacent values only such that display noise is minimized. The method may be applied to color displays in which pixel locations have illumination elements each of a different color, for example a red illumination element, a green illumination element and a blue illumination element.

18 Claims, 6 Drawing Sheets

U.S. PATENT DOCUMENTS 4,486,785 12/1984 Lasher .
4,488,150 12/1984 Kanatani .
4,516,118 5/1985 Wahlquist .
4,559,535 12/1985 Watkins .
4,591,848 5/1986 Morozumi .
4,640,582 2/1987 Oguchi .
4,654,721 3/1987 Goertzel .
4,660,030 4/1987 Maezawa .
4,695,884 9/1987 Anastassiou .
4,706,077 11/1987 Robertz et al. ..... 340/793
4,709,995 12/1987 Kuribayashi .
4,742,346 5/1988 Gillette .
4,743,096 5/1988 Wakai .
4,760,387 7/1988 Ishii et al. ..... 340/716
4,769,713 9/1988 Yasui .
4,775,891 10/1988 Aoki .
4,779,083 10/1988 Ishii .
4,791,417 12/1988 Bobak .
4,797,945 1/1989 Suzuki .
4,805,994 2/1989 Miyajima .
4,808,991 2/1989 Tachiuchi .
4,816,816 3/1989 Usui ..... 340/784
4,827,255 5/1989 Ishii .
4,840,460 6/1989 Bernot .
4,860,246 8/1989 Inoue .
4,872,059 10/1989 Shinabe .
4,908,613 3/1990 Green .
4,921,334 5/1990 Akodes .
4,929,058 5/1990 Numao .
4,956,638 9/1990 Larky et al. ..... 340/793
5,006,840 4/1991 Hamada et al. ..... 340/784
5,025,400 6/1991 Cook .
5,068,649 11/1991 Garrett ..... 345/89
5,073,966 12/1991 Sato ..... 358/429
5,111,194 5/1992 Oneda .
5,122,783 6/1992 Bassetti .
5,185,602 2/1993 Bassetti, Jr. et al. ..... 340/793
5,293,159 3/1994 Bassetti, Jr. et al. ..... 345/149
5,298,915 3/1994 Bassetti, Jr. ..... 345/149

FIG. 6(a)

27

| | |
|---|---|
| a | b |
| c | d |

16 FRAMES

FIG. 6(d)

27

| | |
|---|---|
| 2 | 1 |
| 2 | 2 |

16 FRAMES

FIG. 6(b)

27

| | |
|---|---|
| 1 | 2 |
| 2 | 2 |

16 FRAMES

FIG. 6(e)

27

| | |
|---|---|
| 2 | 2 |
| 1 | 2 |

16 FRAMES

FIG. 6(c)

27

| | |
|---|---|
| 2 | 2 |
| 2 | 1 |

16 FRAMES

FIG. 6(f)

27

| | |
|---|---|
| 1.75 | 1.75 |
| 1.75 | 1.75 |

64 FRAMES

DITHERING PROCESS FOR PRODUCING SHADED IMAGES ON DISPLAY SCREENS

RELATED APPLICATION

The present application is a continuation-in-part of application Ser. No. 07/813,036 which was filed in the United States Patent and Trademark Office on Dec. 24, 1991, now abandoned and commonly assigned herewith, the disclosure of which is incorporated herein in its entirety.

FIELD OF THE INVENTION

The present invention generally relates to processes for providing images on opto-electronic display screens; more particularly, the present invention relates to processes for producing shading in images that are presented in successive frames of video information on opto-electronic display screens such as flat-panel LCDs (liquid crystal displays) and similar display devices.

STATE OF THE ART

In recent years, the computer industry has given significant attention to laptop computer components and, more particularly, to providing laptop computer components with the same functionality as desktop models. One particular challenge has been the opto-electronic displays, such as flat-panel LCDs (liquid crystal displays) and similar display devices, that are employed with laptop computers. Those displays typically are monochrome, in contrast to the high-resolution grey scale and color displays that are common in CRT (cathode ray tube) type screens. Even the grey scale or color LCDs that are commercially available are quite expensive and, typically, are capable only of displaying a narrow range of shades.

LCDs and other flat panel display devices differ from CRT devices in two important aspects. First, in operation of a CRT device, an electron beam is driven to scan rapidly back and forth across a screen to sequentially energize selected picture-element locations, or "pixels", along the generally horizontal scanning lines; the net effect of a complete raster of scans is to reproduce snapshot-like "frames" that each contain video data as to the state of each pixel location on each scanning line. The horizontal scanning lines are organized by synchronizing signals, with each frame containing a fixed number of horizontal lines. The frames are reproduced at a standard rate; for example, the frame repetition rate might be sixty frames per second.

In operation of LCDs and similar flat panel display devices, there is no back and forth scanning of an electron beam—in fact there is no electron beam. Instead, such display devices employ arrays of shift registers, with the result that locations anywhere on a screen can be illuminated simultaneously—i.e,. at exactly the same instant. Nevertheless, in flat panel display devices as in CRT devices that are employed with microprocessor-based computers, video information is still presented in frames. Each frame normally comprises a field which is 640 pixel locations wide by 480 pixel locations high, and the typical frame repetition rate is sixty frames per second (i.e., 60 hertz).

Also, LCDs and similar flat panel display screens differ from CRT devices in that the illumination intensity (i.e., brightness) at the pixel locations cannot be varied. Instead, the illumination intensity at pixel locations on a flat panel display screen is either "on" or "off." (For present purposes, a pixel location will be considered "on" when the pixel location is illuminated and, conversely, a pixel location will be considered "off" when it is not illuminated.) Thus, when a flat panel display screen is fully illuminated—that is, each pixel location is in its "on" state—the screen will have uniform brightness. (In the following, the term "binary display device" refers to display devices whose picture elements have only two display states—either an "on" and an "off" state.)

Because pixel locations on flat panel display screens only have an "on" or "off" state, shading effects cannot be readily produced for images that appear on the screens. To overcome this problem, frame modulation techniques have been employed for simulating grey scale shading of images on binary display devices. Frame modulation techniques basically employ the principal that the frequency with which a pixel location is illuminated determines its perceived brightness and, therefore, its perceived shading.

For example, to display the 25% black tone using simple frame modulation, a display element is made active (inactive) in one-quarter of the frames. Similarly, to display the tone of 75% black, a display element would be made active (inactive) in three-quarter of the frames.

Thus, frame modulation techniques are based on the principle that, for a picture element having only an active state and an inactive state, when the picture element is made active (or inactive) in a certain fraction of successive frames occurring within a short period of time, the human eye will perceive the picture element as having a tone intermediate to tones presented if the display element were constantly active (or constantly inactive). The intermediate tones are determined by the fraction of frames in which the display element is active (inactive). Accordingly, when modulation is performed over a sixteen-frame period, then sixteen different tones may be simulated.

In summary, it can be said that frame modulation techniques takes advantage of persistence and averaging properties of human vision according to which a display element turned on and off at a sufficiently rapid rate is perceived as being continually on and as having a display intensity proportional to the on/off duty cycle of the display element. In conventional practice, frame modulation techniques for producing shading on binary display devices tend to create displays in which the human eye detects considerable turbulence or "display noise".

SUMMARY OF THE INVENTION

The present invention, generally speaking, relates to processes for producing shading in images that are presented in successive frames of video information on flat-panel LCD (liquid crystal display) displays and similar binary display devices while reducing display noise to a minimum. More particularly, the present invention provides a method for simulating non-monochrome display of images on a display device that has an array of picture elements each having only two display states, an ON state and an OFF state.

Stated somewhat differently, the method of the present invention is accomplished by modulating an ON/OFF duty cycle of each picture element of the array of picture elements during a multi-frame display sequence according to attribute information of respective picture element data to be displayed. The timing of ON/OFF and OFF/ON state transitions of the picture elements are coordinated within predetermined neighborhoods throughout the array of picture elements such that the state transitions occur substantially uniformly in space and time within a display neighborhood during the multi-frame display sequence. Accordingly, the present invention takes further advantage of the visual averaging property by causing state transitions to occur substantially uniformly in space and time within each neighborhood throughout the array of picture elements during a multi-frame display sequence. In use of the present invention, no individual state transitions, which by themselves constitute only display noise, are perceived; instead, a coherent pattern of state transitions blending is seen that effectively simulates non-monochrome image displays.

In a preferred embodiment, the present invention provides a method of simulating non-monochrome display of images on a display device that has an array of picture elements each having only two display states, an ON state and an OFF state. An ON/OFF duty cycle of each picture element of the array of picture elements is modulated according to attribute information of respective picture element data to be displayed. The timing of ON/OFF and OFF/ON state transitions of picture elements within predetermined neighborhoods throughout the array of picture elements is coordinated such that the state transitions occur substantially uniformly in space and time within a display neighborhood during the multi-frame display sequences. Using a multi-frame sequence 16 frames in duration, 16 shades of gray may be realized on a monochrome display. Using a multi-frame sequence 64 frames in duration, 64 shades of gray may be realized. Preferably, a multi-frame sequence 64 frames in duration is logically divided into four sub-sequences each 16 frames in duration with the duty cycle of each picture element during each of the four 16-frame sub-sequences being allowed to assume one of two adjacent values only such that display noise is further minimized. That is, a multi-frame sequence M×N frames in duration is logically divided into M (e.g. 4) sub-sequences each N (e.g. 16) frames in duration with the duty cycle of each picture element during each of the M N-frame sub-sequences being allowed to assume one of two adjacent values only within the set {0, 1/M×N, 2/M×N . . . M×N/M×N}.

The same method may be extended to color displays in which pixel locations have a plurality of illumination elements each of a different color, for example a red illumination element, a green illumination element and a blue illumination element. The color shades of each illumination element of a given pixel location are coordinated to produce a desired overall color at that pixel location. Otherwise, the aforedescribed method is applied to the illumination elements of a given color in the same manner as in the monochrome case. That is to say, the timing of state transitions of illumination elements of a given color are coordinated such that the state transitions occur substantially uniformly in space and time within a display neighborhood during the multi-frame display sequence.

BRIEF DESCRIPTION OF THE DRAWINGS

The present invention can be further understood with reference to the following description in conjunction with the appended drawings. In the drawings:

FIG. 2(*b*) shows the display neighborhood in greater detail in the case of a color display in which each pixel location has a red, a green and a blue illumination element;

FIGS. 6(*a*)–(*f*) show various states of a display neighborhood 27 which is two pixels wide by two pixels high;

DETAILED DESCRIPTION OF THE PREFERRED EMBODIMENTS

Figure 1:
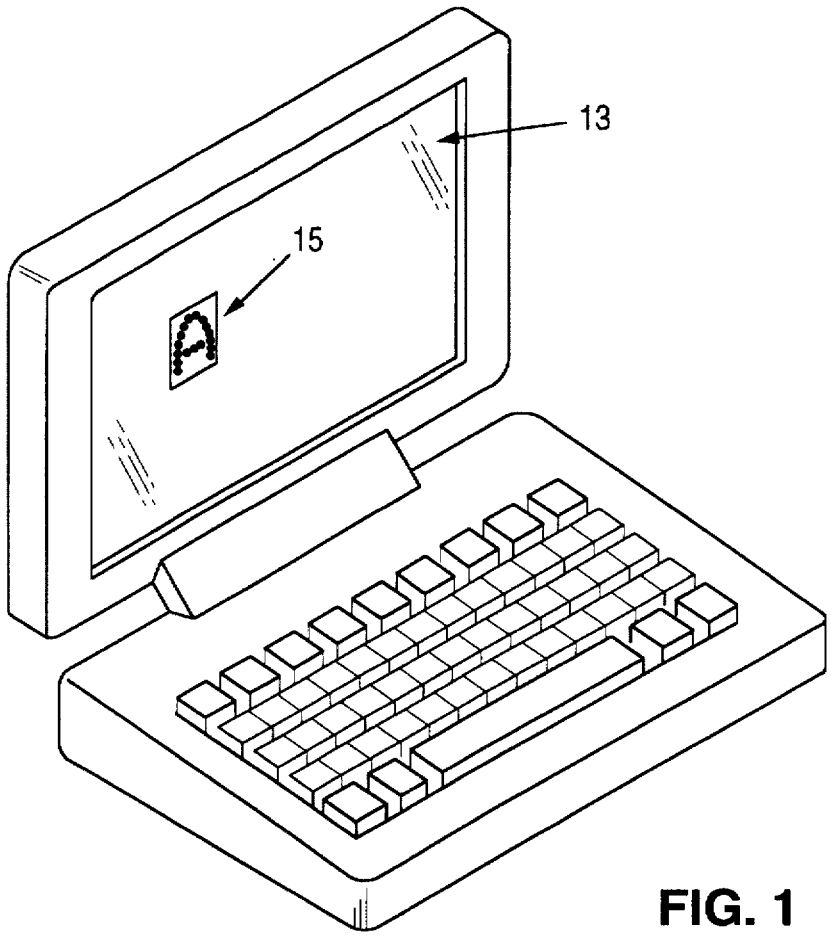
FIG. 1 is a pictorial representation of a display screen having an image field.

FIG. 1 shows an image field 13 that appears on the display screen of a flat-panel LCD or similar binary display device. These devices, as mentioned above, are characterized by the fact that their pixel locations only have two display states—that is, the pixel locations are either illuminated or not. To produce shading in images that are presented in successive frames of video information on such display screens, the image field is subdivided into two-dimensional, uniformly-sized display neighborhoods, such as will be discussed below in conjunction with FIGS. 2–5.

Figure 2A:
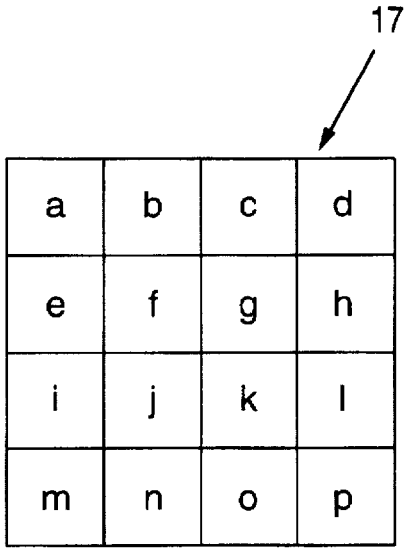
FIG. 2(*a*) shows a display neighborhood of the image field of the display screen of FIG. 1, with the display neighborhood being drawn to a highly enlarged scale for purpose of convenience in describing the process of the present invention.
Figure 2B:
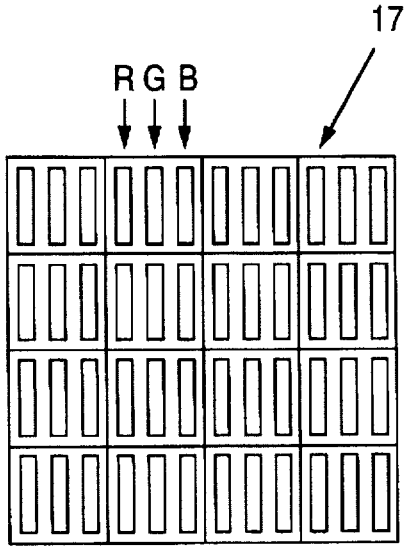

For convenience of discussion, the display neighborhood 17 in FIG. 2(*a*) is shown to be four pixels wide by four pixels high; in other words, display neighborhood 17 is a square that encompasses sixteen pixel locations. Also for convenience of discussion, the sixteen pixel locations in display neighborhood 17 are labelled as locations "a" through "p". In the case of a color display, each pixel location includes three separate illumination elements. In particular, each pixel location includes a red, a green and a blue illumination element as shown in FIG. 2(*b*).

Figure 3:
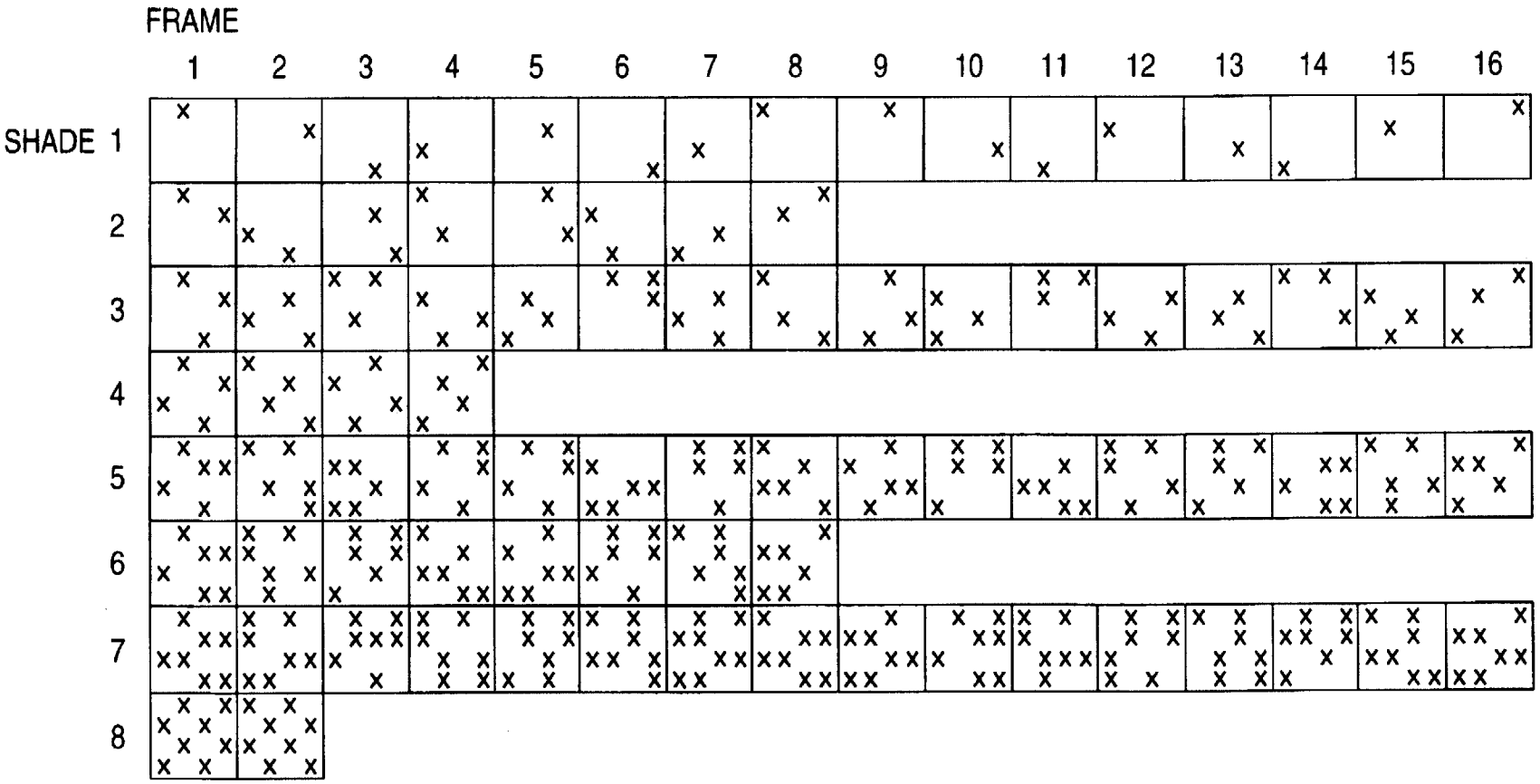
FIG. 3 shows an example of a look-up table for determining the frame sequence for illuminating a given pixel location in the display neighborhood in FIG. 2*a;*

FIG. 3 shows an example of a look-up table for determining the temporal pattern, or frequency, for illuminating the pixel locations in the display neighborhood 17 in order to produce a selected shade or color. In the following, the temporal pattern over which a given pixel location is illuminated will be expressed in terms of a "frame sequence;" thus, the number of times that a given pixel location is illuminated within a frame sequence will determine its brightness and, therefore, will create an appearance of its shade or color relative to other pixel locations.

As will now be explained, the look-up table in FIG. 3 is used in conjunction with a frame modulation process whereby the frequency with which a pixel location is illuminated will determine its perceived brightness and, therefore, its shading or color. For example, if pixel location "a" in FIG. 2(*a*) is illuminated only once over a sequence of sixteen frames, that pixel location will appear as a dark shade relative to other pixel locations that are illuminated more frequently over the same frame sequence. So, if pixel location "e" is illuminated three times over a sequence of sixteen frames, that pixel location will appear as a lighter shade (brighter) relative to pixel location "a." Likewise, if pixel location "b" is illuminated four times over a sequence of sixteen frames, that pixel location will appear as a still lighter shade relative to pixel locations "a" and "e." In practice, it is convenient to employ a frame sequence that comprises sixteen frames, with the frame sequence being repeated between sixty and one-hundred-thirty times per second.

In the look-up table in FIG. 3, the vertical axis indicates shading, from light to dark, over sixteen different shades.

The upper rows of the look-up table, therefore, show pixel illumination patterns that provide the appearance of lighter shades; conversely, the pixel illumination patterns in the lower rows of the look-up table provide the appearance of darker shades. For purposes of the following discussion, the lightest shade will be referred to as shade #1, the next lightest shade will be referred to as shade #2, and so forth.

The horizontal axis in the look-up table in FIG. 3 indicates the frame number. So, for a sixteen-frame sequence the first column in the table represents the first frame of the sequence, the second column represents the second frame of the sequence, and so forth.

Each square area in the look-up table in FIG. 3 shows the state of the pixel locations in the display neighborhood for a selected shading at a given frame number. For example, the look-up table indicates that shade #1 is produced at pixel location "a" by illuminating that pixel location only during the eighth frame of a sixteen-frame sequence. Similarly, the look-up table indicates that shade #1 is produced at pixel location "f" by illuminating that pixel location only during the fifteenth frame of the sixteen-frame sequence. Or, shade #1 is produced at pixel location "d" by illuminating that pixel location only during the sixteenth frame.

As still another example, the look-up table in FIG. 3 indicates that shade #3 is produced at pixel location "e" by illuminating that pixel location during the fourth, tenth, and fifteenth frames of the sixteen-frame sequence. The look-up table similarly indicates that shade #4 is produced at pixel location "b" by illuminating that pixel location during the first, fifth, ninth and thirteenth frames of the sixteen-frame sequence. Thus, for this example, pixel location "e" will appear lighter than pixel location "a," and pixel location "b" will appear as a still lighter—and this is a result of the fact that pixel location "a" is illuminated once in the sixteen-frame sequence, while pixel location "c" is illuminated three times in the sixteen-frame sequence, and pixel location "b" is illuminated four times in the sixteen-frame sequence. The limit, obviously, is to illuminate a pixel location sixteen times in the sixteen-frame sequence.

Upon examination of the look-up table in FIG. 3, it will be seen that, as a general rule, adjacent pixel locations that have the same shade within any one of the display neighborhoods are illuminated with different temporal patterns over a frame sequence. Thus, continuing with the example above for producing shade #1, the look-up table indicates that pixel location "a" is illuminated only during the eighth frame of the sixteen-frame sequence and that pixel location "b" is illuminated only during the first frame of the sequence. Similarly, for producing shade #3 the look-up table indicates that pixel location "e" is illuminated during the fourth, tenth, and fifteenth frames of the sixteen-frame sequence, while pixel location "f" is illuminated during the fifth, eleventh and sixteenth frames to produce the same shade.

The conditions under which a given display neighborhood is to be uniformly shaded can now be readily understood. For instance, if an entire display neighborhood is to have shade #3, the look-up table in FIG. 3 indicates that the three pixel locations "b", "h" and "o" are to be illuminated during the first frame of the sixteen-frame sequence; that the three pixel locations "g," "i" and "p" are to be illuminated during the second frame; that pixel locations "a," "c," and "j" are to be illuminated during the third frame; and so forth. This example can be extended so that a display neighborhood can have any one of sixteen different gray scale shades. Moreover, the same look-up table can be applied to all of the display neighborhoods within an image field.

Figure 4:
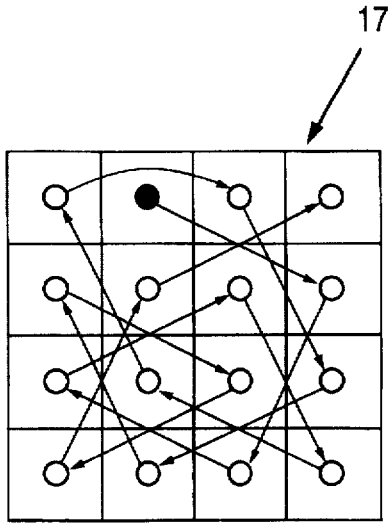
FIG. 4 shows the display neighborhood of FIG. 3 and a preferred pixel transition order within each neighborhood according to the present invention.

FIG. 4 shows an example of a pixel transition order within a display neighborhood. This example is best understood by considering the case where a display neighborhood is to be uniformly shaded with shade #1. In this case the look-up table of FIG. 3 shows that the single pixel location "b" is illuminated during the first frame of the sixteen-frame sequence; that the single pixel location "h" is illuminated during the second frame; that the single pixel location "o" is illuminated during the third frame; and so forth. The same pixel transition order can be seen in FIG. 4 and in fact, that diagram was used as the basis for constructing the look-up table in FIG. 3.

In FIG. 4, the consecutively illuminated pixel locations are connected by linear vectors $v_1$, $v_2$, and so forth. Thus, vector $v_1$, extends from pixel locations "b" to pixel locations "h"; vector $v_2$ extends from pixel locations "h" to pixel locations "o"; and so forth. Although the direction of the vector changes from frame to frame, the vectors have generally the same length. Accordingly, the distances separating consecutively-illuminated pixel locations are generally equal. The concept of providing generally equal separation distance during transitions is important to taking advantage of the visual averaging property. As a result of employing the pixel transition order shown in FIG. 4 to construct the look-up table in FIG. 3, state transitions occur substantially uniformly in space and time within each display neighborhood throughout the array of picture elements during a multi-frame display sequence.

In normal practice, however, a given display neighborhood is not usually uniformly shaded but, instead, shading is to be varied from pixel-to-pixel within the display neighborhood. Nevertheless, the look-up table of FIG. 3 also determines how pixel illumination sequences are selected when the shading at a given pixel location changes—that is, when the shading at a given pixel location is to be made lighter or darker. As a concrete example, assume that pixel location "p" has shade #1 and that a transition to shade #2 is to occur at the beginning of the second frame sequence where each sequence comprises sixteen frames. In that case, when producing shade #1, pixel location "p" is illuminated only in the sixth frame of the first frame sequence. In making the transition to shade #2, pixel location "p" is not illuminated again until the third frame of the second frame sequence; then, that pixel location is illuminated again in the eleventh frame, and so forth.

Figure 5:
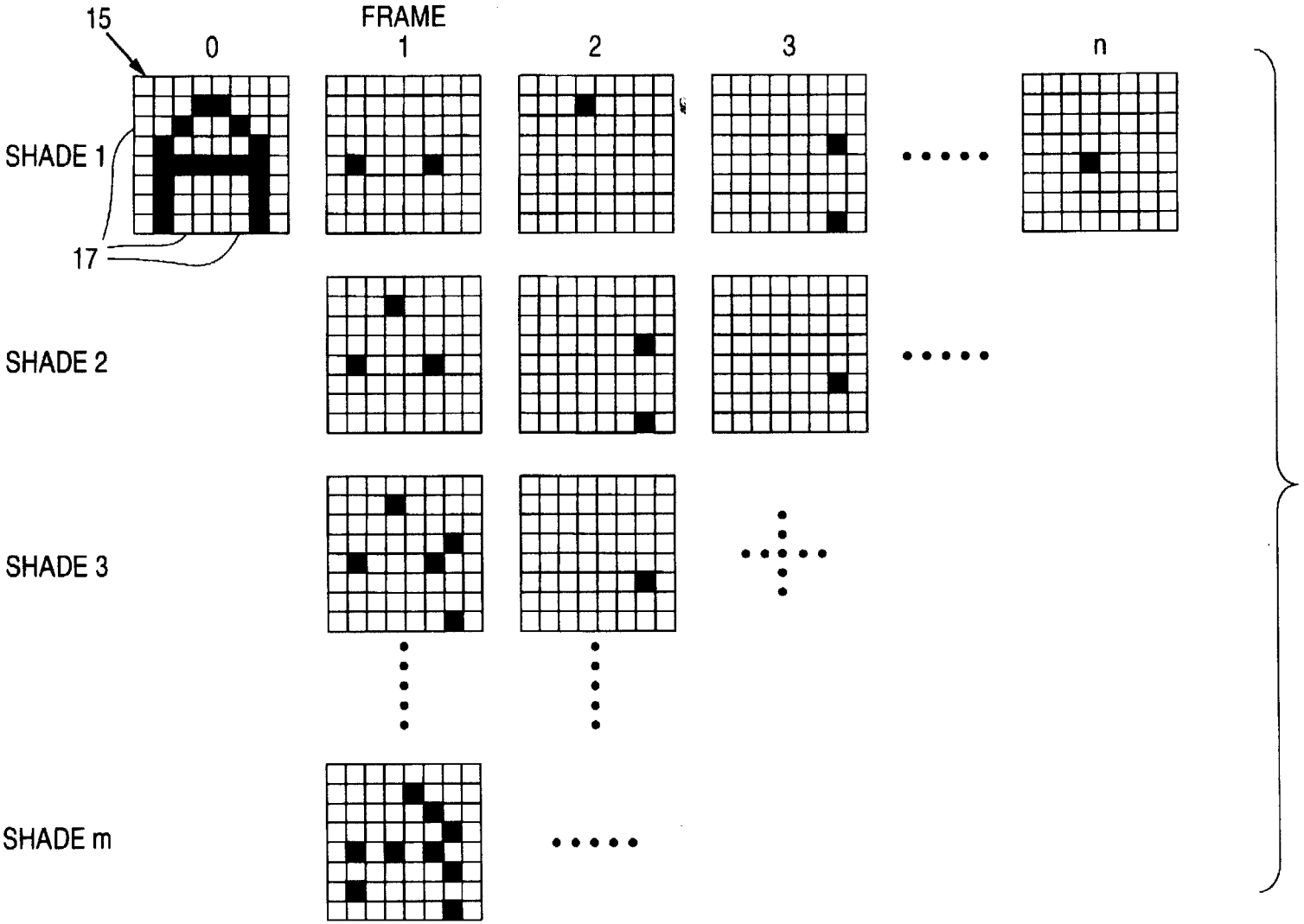
FIG. 5 shows a cluster of four display neighborhoods, with the display neighborhood being drawn to a highly enlarged scale for purpose of further describing the process of the present invention.
Figure 7A:
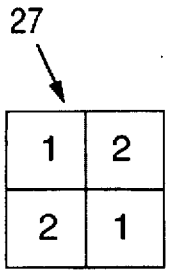
FIGS. 7(*a*)–(*d*) show various states of a display neighborhood 27 which is two pixels wide by two pixels high.
Figure 8A:
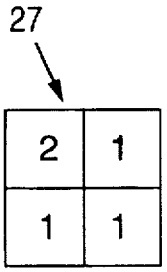
FIGS. 8(*a*)–(*d*) show various states of a display neighborhood 27 which is two pixels wide by two pixels high.
Figure 7B:
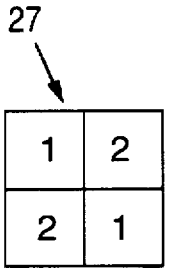
Figure 8B:
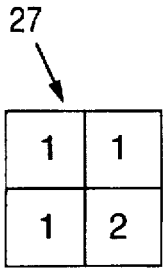
Figure 7C:
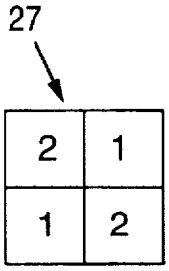
Figure 8C:
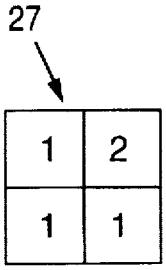
Figure 7D:
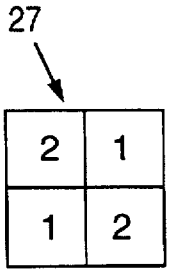
Figure 8D:
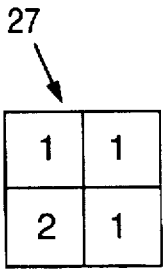

In the preceding example, it was assumed that the transition from one shade to another occurred at the beginning of the first frame of a sixteen-frame sequence. In practice, depending upon the image which is to be presented, it may be desired to change the shade of a given pixel location at any frame within a sixteen-frame sequence. FIG. 5 shows an example of producing the letter "A" in a cluster of four display neighborhoods. If the letter "A" is to have shade 1 for the first and second frames and then is to be changed to shade 2 on the third frame, then the shading for that third frame is determined from the look-up table of FIG. 3. According to this example, only one pixel location would be illuminated during the third frame to initiate the transition to shade 2.

The manner in which the look-up table of FIG. 3 is applied to create the illusion of shading at individual pixel locations is described above. According to that explanation, an individual pixel location can have any one of sixteen different gray scale shades. In the following, a dynamic dithering process will be described that results in permitting each individual pixel location to have any one of sixty-four different gray scale shades.

One embodiment of the dynamic dithering process can be understood in connection with FIG. 6(*a*) which shows a display neighborhood 27 which is two pixels wide by two pixels high; in other words, display neighborhood 27 is a square that encompasses four pixel locations. For convenience of discussion, the four pixel locations in display neighborhood 17 are labelled as locations "a" through "d."

In FIG. 6(*b*), two consecutive shading numbers are assigned to four contiguous pixel locations. In this example, pixel location "a" exhibits shade #1, pixel location "b" exhibits shade #2, pixel location "c" exhibits shade #2, and pixel location "d" also exhibits shade #2. Over a a first sixteen-frame sub-sequence, those pixel locations are illuminated as described above. The average shade perceived by the human eye for the location encompassing the overall area encompassing the four contiguous pixel locations "a" through "d" will be 1.75. The value of this shade is different than either shade #1 or shade #2 and, therefore, the overall area will appear to have a different shade than either shade #1 or shade #2.

In FIG. 6(*c*), different shading numbers are assigned to some of the pixel locations. In this example, pixel location "a" exhibits shade #2, pixel location "b" exhibits shade #2, pixel location "c" exhibits shade #2, and pixel location "d" also exhibits shade #1. Again, those pixel locations are illuminated as described above over a second sixteen-frame sub-sequence. And again, the average shade perceived by the human eye for the overall area encompassing the four contiguous pixel locations "a" through "d" will be 1.75.

In FIG. 6(*d*), still different shading numbers are assigned to some of the pixel locations. In this example, pixel location "a" exhibits shade #2, pixel location "b" exhibits shade #1, and pixel locations "c" and "d" both exhibit shade #2. Again, those pixel locations are illuminated as described above over a a third sixteen-frame sub-sequence. And again, the average shade perceived by the human eye for the overall area encompassing the four contiguous pixel locations "a" through "e" will be 1.75.

Finally, in FIG. 6(*e*), pixel locations "a" and "b" both exhibit shade #2, pixel location "c" exhibits shade #1, and pixel location "d" exhibits shade #2. Again, those pixel locations are illuminated as described above over a a fourth sixteen-frame sub-sequence—with the result that the average shade perceived by the human eye for the overall area encompassing the four contiguous pixel locations is 1.75.

FIG. 6(*f*), shows the sixty-four frame equivalent of the above-described process: namely, pixel locations "a" through "d" all exhibiting a shading value of 1.75. It should now be understood that there are two other ways (i.e., permutations) by which two consecutive shading numbers can assigned to four contiguous pixel locations. One of those permutations is shown in FIGS. 7(*a*) through 7(*d*), and the other permutation is shown in FIGS. 8(*a*) through 8(*d*). When the pixel locations in those permutations are illuminated as described above over a sixteen-frame sequence, the average shade perceived by the human eye for the overall area encompassing the four contiguous pixel locations in FIGS. 7(*a*) through 7(*d*) is 1.5. Similarly, the average shade perceived by the human eye for the overall area encompassing the four contiguous pixel locations in FIGS. 8(*a*) through 8(*d*) is 1.25.

In total, there are five permutations for assigning two consecutive shading numbers to four contiguous pixel locations. When the four contiguous pixel locations in those permutations are illuminated for the above-described examples over a sixteen-frame sequence, the average shades perceived by the human eye have one of the following five values: 1.0, 1.25, 1.5, 1.75, or 2.0. Thus, for the seventeen different shading numbers, forty-eight different intermediate shades can be added by assigning, for each pair of consecutive shading numbers, permutations of those shading numbers to four contiguous pixel locations. Therefore, the total number of possible shades is sixty-five.

It should now be understood that the abovedescribed dynamic dithering process can be applied to the case where a display neighborhood comprises only a single pixel location. For example: for a first sixteen-frame sequence, the shade #1 can be assigned to pixel location "c;" for a second sixteen-frame sequence, the shade #2 can be assigned; for a third sixteen-frame sequence, the shade #2 can be assigned; and, finally, for a fourth sixteen-frame sequence, the shade #2 can be assigned. For this example, the average shade perceived by the human eye for pixel location "c" is 1.25. Because the dynamic dithering process can be applied to a display neighborhood comprising only a single pixel location, rather than four contiguous pixel locations, there is no inherent loss of resolution that results from applying the dynamic dithering process. That is, a multi-frame sequence M×N frames (e.g. 4×16=64 frames) in duration is logically divided into M (e.g. 4) sub-sequences each N (e.g. 16) frames in duration with the duty cycle of each picture element during each of the M N-frame sub-sequences being allowed to assume one of two adjacent values only within the set {0, 1/M×N, 2/M×N . . . M×N/M×N}.

The same dithering process may be applied to color LCD displays in which each pixel location includes a red, a green and a blue illumination element as shown in FIG. 2(*b*). Using dynamic dithering, each illumination element may have any of 64 or $2^6$ colors. Taken together, the three illumination elements of a given pixel location enable that pixel location to have any of $64^3$ or 256K colors. For example, in order to cause a pixel location to have a shade #27 of white, which results when red, green and blue are combined at equal intensities, each of the red, green and blue illumination elements would be turned on six out of sixteen frames for the first sixteen frame sub-sequence of the 64-frame sequence cycle and turned on seven out of sixteen frames for the second sixteen frame sub-sequence, the third sixteen frame sub-sequence, and the last sixteen frame sub-sequence of the sequence. Thus, the color shades of each illumination element of a given pixel location are coordinated to produce a desired overall color at that pixel location. Otherwise, the aforedescribed method is applied to the illumination elements of a given color in the same manner as in the monochrome case, that is to say, the timing of state transitions of illumination elements of a given color are coordinated such that state transitions occur substantially uniformly in space and time within a display neighborhood during the multi-frame display sequence. Furthermore, the process can be generalized to using an M×N sequence consisting of M N-frame sub-sequences.

It can now be understood that the present invention provides a method of simulating display shades on a display device, such as monochrome LCD panel or the like, that does not intrinsically provide display shades. More particularly, the present invention provides a method for realizing a smooth display that effectively convinces the human eye and the human mind to perceive a variety of display shades. Thus, in use of the present invention, no individual state transitions, which by themselves constitute only display noise, are perceived; instead, a coherent pattern of state transitions blending is seen that effectively simulates non-monochrome image displays.

It can also be understood now that the method of the present invention is accomplished by modulating the ON/OFF duty cycle of each picture element of the array of picture elements during a multi-frame display sequence according to attribute information of respective picture element data to be displayed. It is important, as mentioned above, that the timing of ON/OFF and OFF/ON state transitions of the picture elements are coordinated within neighborhoods throughout the array of picture elements such that the state transitions occur substantially uniformly in space and time within a display neighborhood during the multi-frame display sequence. In other words, advantage is taken of the visual averaging property by causing state transitions to occur substantially uniformly in space and time within each neighborhood throughout the array of picture elements during a multi-frame display sequence. Accordingly, no individual state transitions are perceived; instead, a coherent pattern of state transitions blending is seen that effectively simulates non-monochrome image displays.

The foregoing has described the principles, preferred embodiments and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A method of simulating non-monochrome display of images on a display device that has an array of picture elements each having only two display states, an ON state and an OFF state, comprising the steps of:

modulating an ON/OFF duty cycle of each picture element of the array of picture elements during a multi-frame display sequence according to attribute information of respective picture element data to be displayed; and coordinating the timing of ON/OFF and OFF/ON state transitions of picture elements within each of a plurality of predetermined display neighborhoods throughout the array of picture elements such that the state transitions occur substantially uniformly in space and time, within each display neighborhood, during the multi-frame display sequence wherein said multiframe sequence is sixty-four frames in duration and is logically divided into four sub-sequences each sixteen frames in duration, sixty-five display shades being realized by causing the ON/OFF duty cycle of each picture element to have a value within the set {0, 1/64, 2/64 . . . 64/64}, and wherein the ON/OFF duty cycle of each picture element during each of said four sixteen-frame sub-sequences of said sixty-four-frame sequence is caused to have a value within the set {0, 1/16, 2/16 . . . 16/16}.

2. The method of claim 1, comprising the further step of allowing the duty cycle of each picture element during each of said four sixteen-frame sub-sequences of said sixty-four-frame sequence to assume one of two adjacent values only within the set {0, 1/16, 2/16 . . . 16/16}.

3. The method of claim 1, comprising further step of allowing the duty cycle of each picture element during at least one, but not all, of said four sixteen-frame sub-sequences of said sixty-four-frame sequence is allowed to assume only a first of two adjacent values within the set {0, 1/16, 2/16 . . . 16/16} and allowing the duty cycle of each picture element during the others of said four sixteen-frame sub-sequences to assume only a second of said two adjacent values.

4. A method of simulating non-monochrome display of images on a display device that has an array of picture elements each having only two display states, an ON state and an OFF state, comprising the steps of:

modulating an ON/OFF duty cycle of each picture element of the array of picture elements during a multi-frame display sequence according to attribute information of respective picture element data to be displayed; and coordinating the timing of ON/OFF and OFF/ON state transitions of picture elements within each of a plurality of predetermined display neighborhoods throughout the array of picture elements such that the state transitions occur substantially uniformly in space and time, within each display neighborhood, during the multi-frame display sequence wherein said multiframe sequence is M×N frames in duration, M and N being integers, wherein said multiframe sequence is logically divided into M sub-sequences each N frames in duration, wherein M×N+1 display shades are realized by causing the ON/OFF duty cycle of each picture element to have a value within the set {0, 1/M×N, 2/M×N . . . M×N/M×N}, and wherein the ON/OFF duty cycle of each picture element during each of said M N-frame sub-sequences of said M×N sequence is caused to have a value within the set {0, 1/M, 2/M . . . M/M}.

5. The method of claim 4, comprising the further steps of allowing the duty cycle of each picture element during each of said M N-frame sub-sequences of said M×N sequence to assume one of two adjacent values only, within the set {0, 1/M, 2/M . . . M/M}.

6. The method of claim 4, comprising the further steps of allowing the duty cycle of each picture element during at least one, but not all, of said M N-frame sub-sequences of said M×N sequence to assume only a first of two adjacent values, within the set {0, 1/M, 2/M . . . M/M} and allowing the duty cycle each picture element during the other of said M N-frame sub-sequences to assume only a second of said two adjacent values.

7. A method of simulating color display of images on a display device that has an array of picture elements, each picture element having a plurality of illumination elements each of a different color and each having only two display states, an ON state and an OFF state, comprising the steps of:

modulating an ON/OFF duty cycle of at least one illumination element of each picture element of the array of picture elements during a multi-frame display sequence according to attribute information of respective picture element data to be displayed; and coordinating the timing of ON/OFF and OFF/ON state transitions of illumination elements of a given color within each of a plurality of predetermined display neighborhoods throughout the array of picture elements such that the state transitions occur uniformly in space and time, within each display neighborhood, during the multiframe display sequence wherein said multi-frame sequence is M×N frames in duration, M and N being integers, wherein said multi-frame sequence is logically divided into M sub-sequences each N frames in duration, wherein $(M\times N+1)^3$ display colors are realized by causing the ON/OFF duty cycle of each illumination element to have a value within the set {0, 1/M×N, 2/M×N, . . . , M×N/M×N}, and wherein the ON/OFF duty cycle of each illumination element during each of said M N-frame sub-sequences of said M×N sequence is caused to have a value within the set {0, 1/M, 2/M, . . . , M/M}.

8. The method of claim 7, comprising the further steps of allowing the duty cycle of each illumination element during each of said M N-frame sub-sequences of said M×N frame sequence to assume one of two adjacent values only, within the set {0, 1/M, 2/M, . . . , M/M}.

9. The method of claim 7, comprising the further steps of allowing the duty cycle of each illumination element during at least one, but not all, of said M N-frame sub-sequences of said M×N frame sequence to assume only a first of two adjacent values only, within the set {0, 1/M, 2/M, . . . , M/M} and allowing the duty cycle of each illumination element during the other of said M N-frame sub-sequences to assume only a second of said two adjacent values.

10. A display device which simulates non-monochrome display of images, said display device having an array of picture elements, each picture element having only two display states, an ON state and an OFF state, comprising:

modulating means for modulating an ON/OFF duty cycle of each picture element of the array of picture elements during a multi-frame display sequence according to attribute information of respective picture element data to be displayed; and coordinating means for coordinating the timing of ON/OFF and OFF/ON state transitions of picture elements within each of a plurality of predetermined display neighborhoods throughout the array of picture elements such that the state transitions occur substantially uniformly in space and time, within each display neighborhood, during the multi-frame display sequence wherein said multiframe sequence is sixty-four frames in duration logically divided into four sub-sequences each sixteen frames in duration, wherein sixty-five display shades are realized by causing the ON/OFF duty cycle of each picture element to have a value within the set {0, 1/64, 2/64 . . . 64/64}, and wherein the ON/OFF duty cycle of each picture element during each of said four sixteen-frame sub-sequences of said sixty-four-frame sequence is caused to have a value within the set {0, 1/16, 2/16 . . . 16/16}.

11. The display device of claim 10, further comprising:

means for allowing the duty cycle of each picture element during each of said four sixteen-frame sub-sequences of said sixty-four-frame sequence to assume one of two adjacent values only within the set {0, 1/16, 2/16 . . . 16/16}.

12. The display device of claim 10, further comprising:

means for allowing the duty cycle of each picture element during at least one, but not all, of said four sixteen-frame sub-sequences of said sixty-four-frame sequence to assume only a first of two adjacent values within the set {0, 1/16, 2/16 . . . 16/16} and allowing the duty cycle of each picture element during the others of said four sixteen-frame sub-sequences to assume only a second of said two adjacent values.

13. A display device which simulates non-monochrome display of images, said display device having an array of picture elements, each picture element having only two display states, an ON state and an OFF state, comprising:

modulating means for modulating an ON/OFF duty cycle of each picture element of the array of picture elements during a multi-frame display sequence according to attribute information of respective picture element data to be displayed; and coordinating means for coordinating the timing of ON/OFF and OFF/ON state transitions of picture elements within each of a plurality of predetermined display neighborhoods throughout the array of picture elements such that the state transitions occur substantially uniformly in space and time, within each display neighborhood, during the multi-frame display sequence, wherein said multiframe sequence is M×N frames in duration, M and N being integers, wherein said multiframe sequence is logically divided into M sub-sequences each N frames in duration, wherein M×N+1 display shades are realized by causing the ON/OFF duty cycle of each picture element to have a value within the set {0, 1/M×N, 2/M×N . . . M×N/M×N}, and wherein the ON/OFF duty cycle of each picture element during each of said M N-frame sub-sequences of said M×N sequence is caused to have a value within the set {0, 1/M, 2/M . . . M/M}.

14. The display device of claim 13, further comprising:

means for allowing the duty cycle of each picture element during each of said M N-frame sub-sequences of said M×N sequence to assume one of two adjacent values only, within the set {0, 1/M, 2/M . . . M/M}.

15. The display device of claim 13, further comprising:

means for allowing the duty cycle of each picture element during at least one, but not all, of said M N-frame sub-sequences of said M×N frame sequence to assume only a first of two adjacent values within the set {0, 1/M, 2/M . . . M/M} and allowing the duty cycle of each picture element during the others of said M N-frame sub-sequences to assume only a second of said two adjacent values.

16. A display device which simulates color display of images, said display device having an array of picture elements, each picture element having a plurality of illumination elements each of a different color and each having only two display states, an ON state and an OFF state, comprising:

modulating means for modulating an ON/OFF duty cycle of at least one illumination element of each picture element of the array of picture elements during a multi-frame display sequence according to attribute information of respective picture element data to be displayed; and coordinating means for coordinating the timing of ON/OFF and OFF/ON state transitions of illumination elements of a given color within each of a plurality of predetermined display neighborhoods throughout the array of picture elements such that the state transitions occur uniformly in space and time, within each display neighborhood, during the multiframe display sequence, wherein said multi-frame sequence is M×N frames in duration, M and N being integers, wherein said multi-frame sequence is logically divided into M sub-sequences each N frames in duration, wherein $(M\times N+1)^3$ display colors are realized by causing the ON/OFF duty cycle of each illumination element to have a value within the set {0, 1/M×N, 2/M×N, . . . , M×N/M×N}, and wherein the ON/OFF duty cycle of each illumination element during each of said M N-frame sub-sequences of said M×N sequence is caused to have a value within the set {0, 1/M, 2/M, . . . , M/M}.

17. The display device of claim 16, further comprising:

means for allowing the duty cycle of each illumination element during each of said M N-frame sub-sequences of said M×N frame sequence to assume one of two adjacent values only, within the set {0, 1/M, 2/M, . . . , M/M}.

18. The display device of claim 16, further comprising:

means for allowing the duty cycle of each illumination element during at least one, but not all, of said M N-frame sub-sequences of said M×N frame sequences to assume only a first of two adjacent values within the set {0, 1/M, 2/M, . . . , M/M} and allowing the duty cycle of each illumination element during the other of said M N-frame sub-sequences to assume only a second of said two adjacent values.

* * * * *